US006386009B1

(12) United States Patent
Ni et al.

(10) Patent No.: US 6,386,009 B1
(45) Date of Patent: May 14, 2002

(54) METHOD AND APPARATUS FOR HYDROFORMING MULTIPLE COMPONENTS WITH REDUCED PRESS LOADING

(75) Inventors: Chi-Mou Ni, Troy; James Chatterley, Washington, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/718,183

(22) Filed: Nov. 21, 2000

(51) Int. Cl.[7] ..... B21D 26/02

(52) U.S. Cl. ..... 72/61; 72/58; 72/404; 72/455; 29/421.1

(58) Field of Search ..... 72/58, 61, 404, 72/421.1, 455, 62, 456, 472; 29/430, 421.1

(56) References Cited

U.S. PATENT DOCUMENTS 1,844,098 A * 2/1932 Lytle ..... 72/60
2,222,762 A * 11/1940 Debor et al. ..... 72/61
2,331,015 A * 10/1943 Dawes et al. ..... 72/208
2,869,177 A * 1/1959 Jurgeleit ..... 72/456
6,006,568 A * 12/1999 Bihrer ..... 72/60
6,170,309 B1 * 1/2001 Marando ..... 72/61

* cited by examiner

*Primary Examiner*—David Jones
(74) *Attorney, Agent, or Firm*—Laura C. Hargitt

(57) ABSTRACT

Apparatus and method for hydroforming multiple components simultaneously with a smaller capacity press than would be possible using conventional hydroforming methods and apparatus. Die pairs are positioned with multiple die cavities in series so that the separating force transmitted to a press holding the dies equals the force developed in a single die cavity, even though multiple components are being formed in the die cavities.

3 Claims, 2 Drawing Sheets

METHOD AND APPARATUS FOR HYDROFORMING MULTIPLE COMPONENTS WITH REDUCED PRESS LOADING

TECHNICAL FIELD

This invention relates to hydroforming methods and apparatus.

BACKGROUND OF THE INVENTION

It is known in the art relating to hydroforming to provide a die set with upper and lower dies forming multiple die cavities in which hydroforming of multiple components is performed simultaneously. The hydroforming process involves applying internal hydraulic pressures in the die cavities, often on the order of 10,000 psi ($69\times10^6$ Pa). The press in which the die set is mounted must apply sufficient force to maintain the dies closed against the internal forces developed in the totality of all the die cavities which are, in effect, mounted in parallel within the press. For larger components, this results in a requirement for very high press loadings, calling for a very large and expensive press.

SUMMARY OF THE INVENTION

The present invention provides a method and apparatus for hydroforming multiple components in a press containing dies having multiple die cavities arranged to limit the press loading to essentially that required to hydroform a single component in a single die cavity. This is accomplished by aligning the multiple die cavities in series in the press so that the separating forces of only the die members at the ends of the series act against the press with a force equal to only the separating force of a single die cavity. The forces of the intermediate dies are internally balanced by the forces acting in the adjacent die cavities and so do not add any additional force to that of the single cavity acting on the press.

The apparatus accordingly includes: a plurality of mating hydroforming die pairs engagable to form a plurality of aligned and spaced hydroforming die cavities having parting lines of the die pairs extending generally laterally to the direction of alignment of the die pairs; a press operative to load the engaged die pairs in the direction of alignment; and means for simultaneously hydroforming components in the die cavities while the dies are loaded.

The method involves: arranging in essentially linear alignment die pairs forming a plurality of separate die cavities, with the die pairs positioned such that internal separating loads in the die pairs act in alignment with the die cavities; and loading the die pairs in a press in the direction of alignment of the die cavities while simultaneously hydroforming components in each of the die cavities.

These and other features and advantages of the invention will be more fully understood from the following description of certain specific embodiments of the invention taken together with the accompanying drawings.

DESCRIPTION OF THE PREFERRED EMBODIMENT

Figure 1:
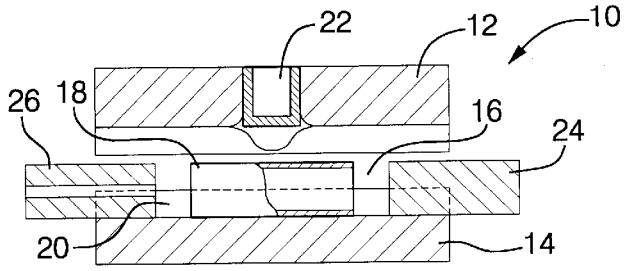
PRIOR ART FIG. 1
FIGS. 1–4 are schematic cross-sectional views illustrating steps in a conventional tubular hydroforming process for a single component.

Referring now to the drawings in detail, numeral 10 generally indicates a forming station for tubular hydroforming of a single tubular component, in this case a copper plumbing tee, not shown. Station 10 includes an upper die 12 and a lower die 14 forming a die pair 12, 14 mounted in a press, not shown. The dies are movable together to define a die cavity 16 in which a tubular workpiece 18 is positioned for hydroforming. The die cavity 16 has a generally cylindrical portion 20 open at its ends, and a lateral bore with a control piston 22 extending from the center of the cavity 16 through the upper die 12. Cylindrical end seals 24, 26 are provided to close open ends of the cavity 16. External pistons 28, 30 are provided to activate the end seals.

Figure 2:
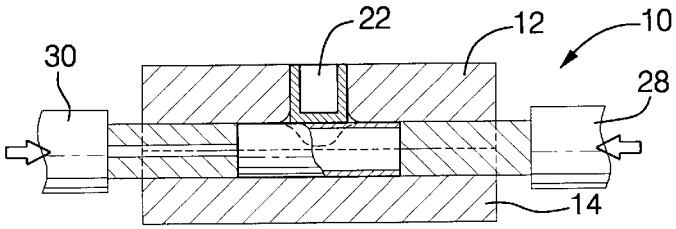
PRIOR ART FIG. 2

In operation of the forming station 10, a tubular workpiece 18 is placed in the lower die 14 portion of the die cavity 16 when the upper die 12 is raised for loading of the workpiece as shown in FIG. 1. The dies are closed and pistons 28,30 force the seals 24,26 against the open ends of the workpiece 18 as shown in FIG. 2. The workpiece is filled with hydroforming fluid, usually water mixed with a suitable amount of corrosion resisting oil, which may be fed to the workpiece through the hollow seal 26.

Figure 3:
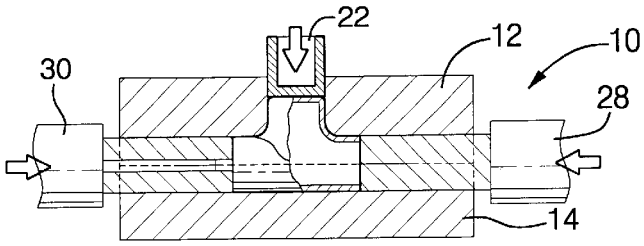
PRIOR ART FIG. 3

As is shown in FIG. 3, the pistons 28, 30 then move in further to force the seals 24, 26 against the ends of the workpiece and to force the workpiece ends axially inward and increase the hydraulic pressure in the workpiece to a sufficient value, such as 10,000 psi, for hydroforming the workpiece. The hydroforming action shortens the length of the workpiece and redistributes the compressed metal to form a lateral leg with a closed end on the workpiece 16, extending up into the lateral bore against piston 22.

Figure 4:
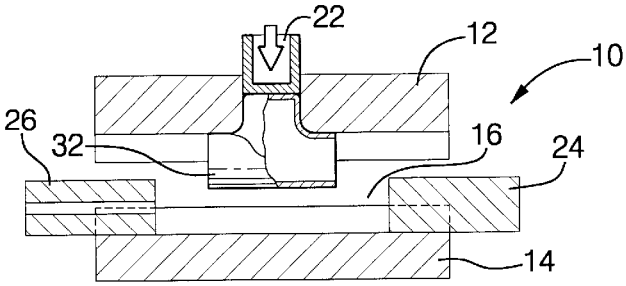
PRIOR ART FIG. 4

The fluid pressure is released, the dies 12, 14 are then opened and a hydroformed component 32 is ejected from the upper die as shown in FIG. 4. The component 32 is further processed, by cutting off the closed end of the lateral leg after the hydroforming process, to obtain the finished plumbing tee, not shown. A new workpiece 18, is then inserted into the lower die 14 and the process is repeated.

Figure 5:
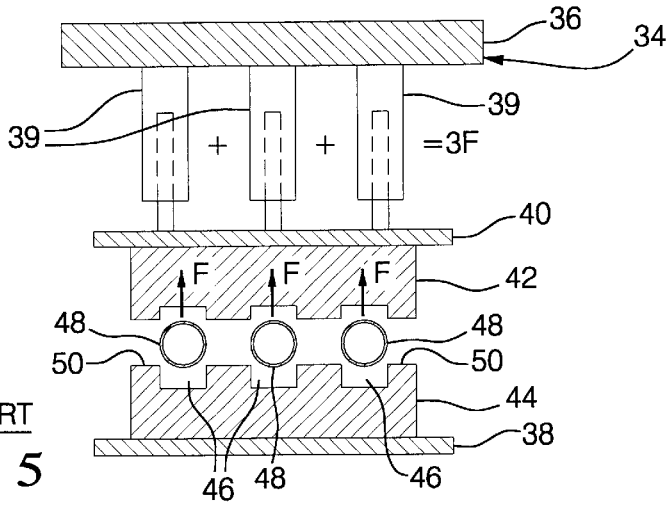
PRIOR ART FIG. 5
FIG. 5 is a schematic cross-sectional view of conventional apparatus for simultaneous tubular hydroforming of a plurality of components.

In FIG. 5, a conventional apparatus for forming multiple workpieces is shown schematically as a press 34 including a frame having an upper member 36 and a lower platen 38 fixed to the frame. The press is provided with actuating means of any suitable type, shown in the illustrated embodiment as three hydraulic cylinders 39 fixed to the upper member 36 and movably carrying an upper platen 40. An upper die 42 is mounted on the upper platen and mates with a lower die 44 mounted on the lower platen 38. The die pair 42, 44, when closed, together define three side by side die cavities 46 in which three tubular workpieces 48 may be simultaneously hydroformed into individual components, not shown in the manner previously described in connection with FIGS. 1–4.

It is noted that the die cavities 46 are arranged in parallel, i.e. laterally to the direction of motion of the press 34 and to the application of force on the dies by the press. Also, the parting lines 50 of the die cavities extend parallel to the direction of alignment of the die cavities. Thus, the hydraulic forming pressures developed in the die cavities result in separating forces in the cavities that are added together and act against the force of the press 34. The size and load capacity of the press required for hydroforming multiple components with this conventional apparatus is, thus, a multiple of the number of hydroforming cavities formed in parallel within the die pair 42, 44. This limits the number of multiple components which may be simultaneously formed in a particular press using this method and apparatus, or requires a substantially larger press to form more components.

Figure 6:
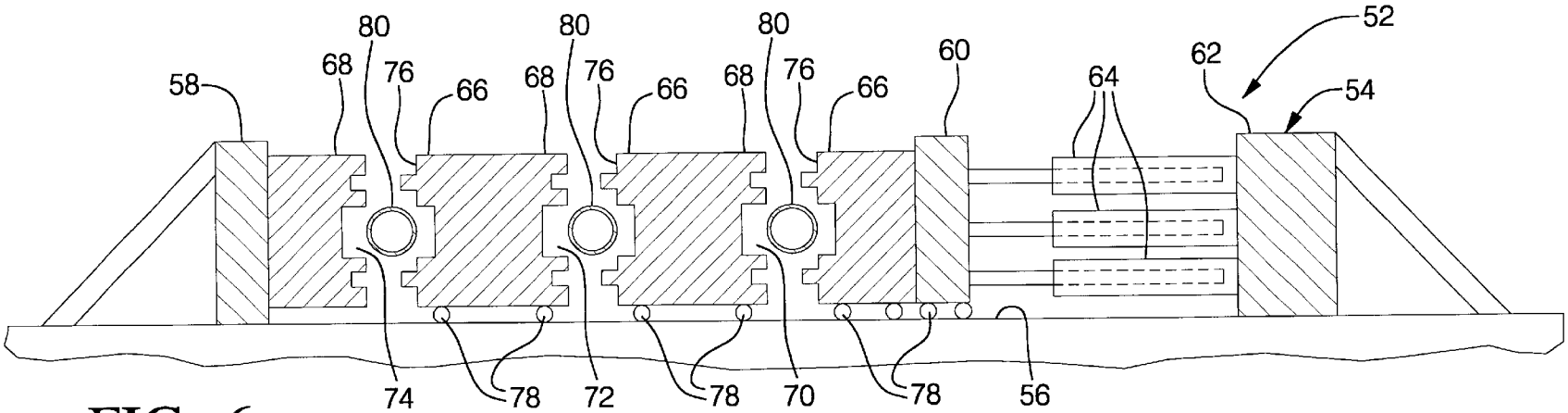
FIGS. 6 and 7 are schematic cross-sectional views of apparatus in accordance with the invention illustrating the method of operation of the apparatus.
Figure 7:
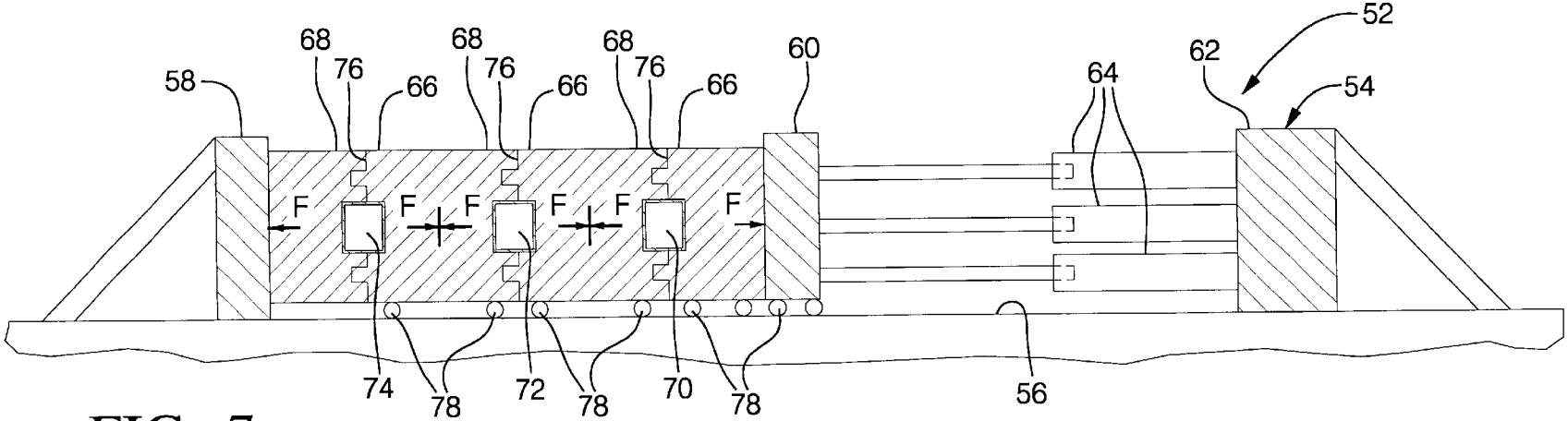

Referring now to FIGS. 6 and 7, an improved apparatus 52 made in accordance with the invention is shown. Apparatus 52 preferably includes a horizontal press 54 having a generally horizontal slide or table 56 (although a vertical or otherwise oriented press could be made applicable if desired). A stationery abutment or fixed platen 58 is located at one end of the table 56. At the other end, a horizontally movable slider or movable platen 60 is connected with a fixed frame or abutment 62 by one or more actuating members such as hydraulic cylinders 64. Suitable pneumatic, electric or mechanical or other forms of hydraulic actuating devices could be substituted if desired.

Between the platens 58, 60, there are aligned a plurality of die pairs made up of alternating pairs of mating dies 66, 68. When closed, the die pairs define a plurality of aligned and longitudinally spaced hydroforming die cavities 70, 72, 74 in which hydroformed components may be formed in the manner previously described in connection with FIGS. 1–4. The die cavities are aligned longitudinally in series between the fixed and movable platens 58, 60 of the press 54. Also, the die pairs 66, 68 have parting lines 76 that extend laterally (vertically) to the (horizontal) direction of alignment of the die pairs. As a result, the longitudinally aligned die cavities 70, 72, 74 develop, from the hydraulic pressures therein, separating forces which act essentially normal to the parting lines 76 and, therefore, in alignment with the horizontal line of action of the press 54. The result is that the separating forces of only the outer portions of the end die cavities 70, 74 act against the press 54. The separating forces acting on the inner portions of cavities 70, 74 are opposed and balanced by the separating forces acting within the center cavity 72. Therefore, only the effective forces of one die cavity are applied against the hydraulic cylinders of the press 54 and these forces are not increased by having additional die cavities in series within the press.

In the exemplary embodiment of the invention shown in FIGS. 6 and 7, the die pairs 66, 68 may be made up of individual end dies 66 and 68 and integrally combined intermediate dies 66, 68. However, the intermediate dies could be made as individual die members fixed together or otherwise arranged to open and close the die cavities 70, 72, 74 as needed. Note also that the dies 66, 68, as well as the movable platen 60, move on wheels 78 or rollers on the horizontal table 56. However, these members could alternatively slide on ways or ride on tracks or move on any other suitable form of horizontal transfer means.

In operation, the die pairs are first opened as shown in FIG. 6 so that tubular workpieces 80 may be inserted into the open die cavities 70, 72, 74. The dies are then closed by advancing the cylinders 64 to close the die cavities and allow hydroforming of the workpieces 80 in the manner described in FIGS. 1–4. Suitable linkage or other means may be utilized in opening the dies to return the movable die pairs 66, 68 to their original positions shown in FIG. 6 so that the hydroformed parts can be removed and replaced by new workpieces to be formed.

The apparatus and method of the invention make possible the hydroforming of multiple components simultaneously with a smaller capacity press than would be possible using conventional hydroforming methods and apparatus. While the detailed description refers in particular to hydroforming of tubular workpieces, the invention may also be applied to hydroforming of sheets or other forms of workpieces.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A hydroforming apparatus for simultaneously forming multiple, discrete workpieces, the apparatus comprising:

a plurality of mating hydroforming die pairs engagable to form a plurality of distinct and separated hydroforming die cavities arranged along an alignment axis and having parting lines of the die pairs spaced and extending generally parallel to each other, wherein the parting lines are generally perpendicular to the alignment as of the die pairs;

a press operative to load the engaged die pairs in the direction of the alignment axis; and means for simultaneously hydroforming a discrete workpiece in each die cavity while the dies are loaded, whereby the separating forces on dies at the ends of the aligned die pairs act on the press while the forces on intermediate dies between the end dies are balanced by equal and opposite forces acting in adjacent die cavities.

2. The apparatus as in claim 1 wherein the alignment axis of the die cavities and the press are horizontal and the die pairs are horizontally movable into closed and open positions.

3. A method of hydroforming a plurality of components in separate die cavities held closed by a press while limiting the hydroforming load on the press to essentially the load developed in one of the die cavities, the method comprising:

arranging die pairs forming the separate die cavities in essentially linear alignment in the direction of loading in a press with the die pairs positioned such that internal separating loads on the die pairs act in alignment with the die cavities;

loading the die pairs with the press in the direction of alignment of the die cavities and simultaneously hydroforming the components in each of the aligned die cavities;

whereby the separating forces on dies at the ends of the aligned die pairs act on the press while the forces on intermediate dies between the end dies are balanced by equal and opposite forces acting in adjacent die cavities.

* * * * *